US009290706B2

(12) United States Patent
Zhao et al.

(10) Patent No.: US 9,290,706 B2
(45) Date of Patent: Mar. 22, 2016

(54) INTEGRATED PROCESS FOR UPGRADING HEAVY OIL

(71) Applicant: CHINA UNIVERSITY OF PETROLEUM-BEIJING, Beijing (CN)

(72) Inventors: Suoqi Zhao, Beijing (CN); Xuewen Sun, Beijing (CN); Zhiming Xu, Beijing (CN); Chunming Xu, Beijing (CN); Keng H. Chung, Beijing (CN)

(73) Assignee: CHINA UNIVERSITY OF PETROLEUM-BEIJING, Bejing (CN)

( * ) Notice: Subject to any disclaimer, the term of this patent is extended or adjusted under 35 U.S.C. 154(b) by 410 days.

(21) Appl. No.: 13/851,802

(22) Filed: Mar. 27, 2013

(65) Prior Publication Data

US 2013/0206642 A1 Aug. 15, 2013

Related U.S. Application Data

(63) Continuation-in-part of application No. PCT/CN2012/070535, filed on Jan. 18, 2012.

(30) Foreign Application Priority Data

May 31, 2011 (CN) ..... 2011 1 0145021

(51) Int. Cl.
*C10G 55/04* (2006.01)
*C10G 69/06* (2006.01)
(Continued)

(52) U.S. Cl.
CPC ..... *C10G 55/04* (2013.01); *C10G 21/003* (2013.01); *C10G 21/14* (2013.01); *C10G 69/06* (2013.01); *C10G 2300/206* (2013.01); *C10G 2300/4081* (2013.01); *C10G 2300/44* (2013.01)

(58) Field of Classification Search
CPC ..... C10G 53/02; C10G 53/04; C10G 55/00; C10G 55/02; C10G 55/04; C10G 67/04; C10G 69/06
See application file for complete search history.

(56) References Cited

U.S. PATENT DOCUMENTS 2,847,353 A 8/1958 Beavon et al. ..... 196/14.11
2,901,413 A 8/1959 Newchurch et al. ..... 208/55
(Continued)

FOREIGN PATENT DOCUMENTS

CA 2 524 995 1/2011
CN ZL01141462.6 9/2001
(Continued)

OTHER PUBLICATIONS

Chinese First Examination Report of corresponding Chinese Application No. 201110145021.9 dated Oct. 22, 2013, now granted as publication No. 102807892B on Apr. 9, 2014.
(Continued)

*Primary Examiner* — Brian McCaig
(74) *Attorney, Agent, or Firm* — J.C. Patents

(57) ABSTRACT

The invention provides an integrated process for processing heavy oil, wherein the integrated process at least comprises: solvent deasphalting is carried out for heavy oil material, and de-oiled asphalt phase is mixed with dispersing agent and then entered a thermal cracking reactor to undergo thermal cracking reactions. Upgraded oil can be obtained through the mixture of the de-asphalted oil and thermal cracking oil separated from thermal cracking reaction products. The solvent and heavy gas oil, which are separated from the thermal cracking reaction products, are respectively recycled back to the solvent deasphalting process as solvent and as mixed feed to remove asphaltene. The integrated process of the present invention solves the problems that solvent is difficult to be separated from asphalt with high softening point in solvent deasphalting process and hard asphalt is difficult to be transported.

20 Claims, 1 Drawing Sheet

(51) Int. Cl.

| | |
|---|---|
| ***C10G 21/00*** | (2006.01) |
| ***C10G 21/14*** | (2006.01) |
| *C10G 53/02* | (2006.01) |
| *C10G 53/04* | (2006.01) |
| *C10G 67/04* | (2006.01) |

(56) References Cited

U.S. PATENT DOCUMENTS

| | | | | |
|---|---|---|---|---|
| 3,287,254 | A | 11/1966 | Paterson et al. | 208/68 |
| 4,235,702 | A | 11/1980 | Smith | 208/87 |
| 4,294,686 | A * | 10/1981 | Fisher et al. | 208/56 |
| 4,405,441 | A * | 9/1983 | Van Dongen et al. | 208/61 |
| 5,013,427 | A | 5/1991 | Mosby et al. | 208/211 |
| 6,673,234 | B2 | 1/2004 | Li et al. | 208/86 |
| 7,597,797 | B2 | 10/2009 | Gregory | 208/131 |

FOREIGN PATENT DOCUMENTS

| | | | |
|---|---|---|---|
| CN | 1101846 | C | 2/2003 |
| CN | 1142247 | C | 3/2004 |
| CN | 1142259 | C | 3/2004 |
| CN | ZL200510080799.0 | | 7/2005 |
| CN | 102807892 | B | 4/2014 |
| EP | 1 268 713 | | 1/2003 |
| FR | 2 888 245 | | 1/2007 |

OTHER PUBLICATIONS

International Search Report of International Application No. PCT/CN2012/070535, dated May 3, 2012.

The extended European search report of corresponding international PCT Application No. PCT/CN2010/070535 dated May 19, 2019, 2014.

* cited by examiner

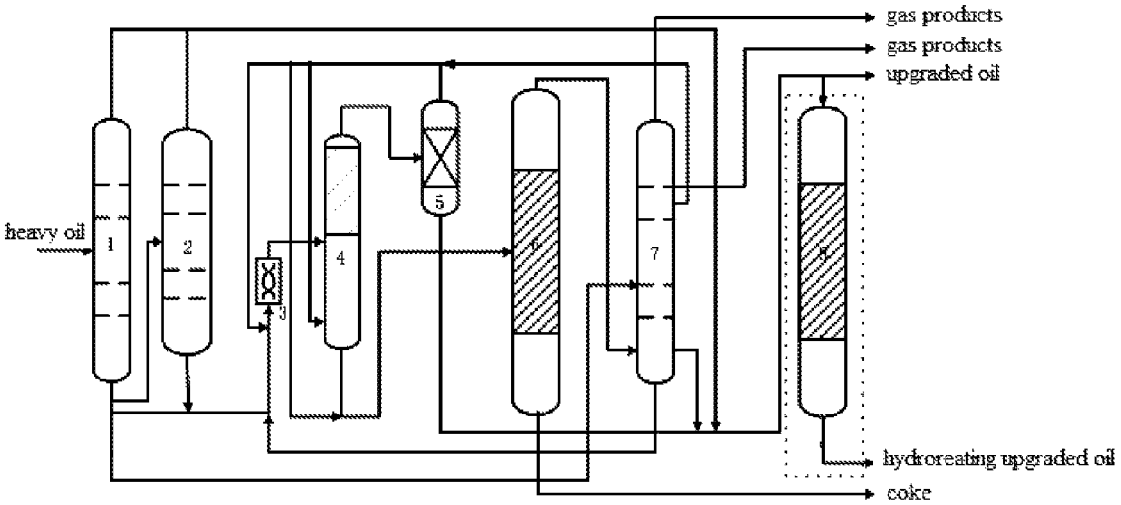
gas products
gas products
upgraded oil
heavy oil
1
2
3
4
5
6
7
8
hydroreating upgraded oil
coke

INTEGRATED PROCESS FOR UPGRADING HEAVY OIL

CROSS-REFERENCE TO RELATED APPLICATIONS

This application is a continuation-in-part of International Application No. PCT/CN2012/070535, filed on Jan. 18, 2012, which claims priority to Chinese Patent Application No. 201110145021.9, filed on Mar. 31, 2011, both of which are hereby incorporated by reference in their entireties.

FIELD OF THE TECHNOLOGY

The invention relates to an integrated process for deeply upgrading of heavy oil, in particular to a integrated process for producing high-quality upgraded oil, including prefractionation of heavy crude oil, extra heavy crude oil and oil sand bitumen, heavy-fraction deasphalting process, thermal cracking process and fixed-bed hydrotreating process. The integrated process belongs to the heavy oil processing field.

BACKGROUND

Heavy oil is the petroleum with API gravity lower than 20 (its density is higher than 0.932 g/cm$^3$ at the temperature of 20° C.), generally comprising heavy crude oil, oil sand bitumen and residue. As the heavy crude oil and the oil sand bitumen have high density, high viscosity and high freezing point, they will lose flowability at ambient temperature or even higher temperature, and cannot be transported and processed like conventional crude oil. Particularly, the extra heavy oil and the oil sand bitumen with API gravities lower than 10 need to be blended with diluent or to be converted to light fraction, so as to form synthetic oil, which is then transported to a refinery to be processed. Therefore, the research and development of light fraction conversion and processing technology for the heavy oil is always a topic attracting wide interest in the industry.

One of the most important technologies of the heavy oil processing is the secondary upgrading for oil products. With the thermal reaction treatments of heavy oil components, for example, heavy oil hydrotreating, the hydrotreating of coking products, partial thermal cracking of heavy distillate products, etc., the upgraded products of the heavy oil (upgraded oil or synthetic oil) can be obtained. The secondary upgrading is beneficial for solving the stability problem of the thermal reaction products and removing impurities (such as sulfur and so on) in crude oils, thus obtaining the synthetic oil being more clean and stable and with increased APT gravity. The upgraded oil or the synthetic oil has good flowability, which can be easily transported to a refinery; in addition, the impurities, asphaltenes, metals and carbon residue precursors in the treated upgraded oil are removed significantly, thus improving the quality of the oil and also convenient for the subsequent oil processing.

The key heavy components influencing the quality of the heavy oil are asphaltenes and metal, therefore, the deasphalting process is also an important step for converting the heavy oil to light oil. As for the heavy oil process, the de-asphalted oil with good properties can be obtained from the heavy oil through a solvent deasphalting process. However, the selection of the extraction solvent and the determination of the operating parameters for extraction process are greatly restricted by the properties of asphalt, which has the characteristics of high softening point, high viscosity and easily forms coke by heating. The existing problems firstly are that the asphalt with high softening point and the solvent are difficult to be separated that it is difficult to increase yield of de-asphalted oil, and secondly are that hard asphalt is difficult to be transported because of its high viscosity and easily forms coke by heating. Under the restrictions of these technical problems, the oil yield of the de-asphalted oil process for heavy oil, extra heavy oil and oil sand bitumen is low and a large quantity of asphalt needs to be processed or utilized in other proper ways, during the solvent deasphalting process currently.

In order to improve the heavy oil processing, combined processes with various matching designs are disclosed and utilized. Their purposes are all that: through more than two combined treatment processes, the heavy oil is processed and upgraded more effectively, improving its API gravity and producing the corresponding upgraded oil (it is also called as synthetic oil). In some combined processes, the de-asphalted oil and de-oiled asphalt are obtained through the solvent deasphalting process, which is a necessary process for various combined processes, such as the combined process of the solvent deasphalting process and delayed coking process, the combined process of the solvent deasphalting process and hydrotreating process, and so on. For example, Europe Patent No. EP1268713(A1) discloses a process for upgrading heavy oil feedstock. By using the solvent deasphalting process, the de-asphalted oil and the de-oiled asphalt are obtained and respectively subjected to slurry-bed hydrocracking. The upgraded oil and the unreformed asphalt are separated from hydrotreating products. The asphalt with the boiling point more than 1025° F. can be taken as coked feedstock and POX gasification feedstock. U.S. Pat. No. 6,673,234 discloses a combined process of initial solvent deasphalting process followed by delayed coking process. After the residual oil is treated in the solvent deaspholting process, the de-asphalted oil obtained is processed in the delayed coking, which can lengthen coking cycle time and produce needle coke. In the combined process, which has been used or disclosed, involving solvent deasphalting processes, it is necessary to separate the solvent in the de-oiled asphalt. That is, solvent needs to be separated from de-oiled asphalt firstly and, then, the de-oiled asphalt enters the sequent combined process. Therefore, the two problems associated with the asphalt with high softening point and the solvent are difficult to be separated from each other during the solvent deasphalting process and the asphalt with high softening point is hard to be transported are not solved. On the other hand, currently, as for the heavy oil process technology, the difficulty of the separation of the de-oiled asphalt from the solvent is reduced at the cost of lowering the yield of de-asphalted oil, thus increasing the quantity of de-oiled asphalt. As the oil component in the asphalt is relatively high, the quantity of coke produced in cocking process after the thermal reaction of the asphalt is also increased; that is, the amount of the coke and the gas are difficult to be decreased. Still on the other hand, in order to reduce the difficulty of separation of solvent from the asphalt with high softening point and the difficulty of transporting of the asphalt with high softening point, the oil component residues in the de-oiled asphalt is relatively high. During the thermal cracking process, part of the oil component undergoes condensation reaction, and then the quantity of coke in the thermal reaction is necessarily increased, thus influencing not only the liquid yield but also the stability of the upgraded products.

SUMMARY

The main technical problem that the invention solves is to provide an integrated process for processing heavy oil.

Through prefrationation of the heavy oil in combination with a solvent deasphalting process and an asphalt thermal cracking process, the extraction solvent used for deasphalting and the heavy gas oil separated from the asphalt thermal cracking reaction are respectively recycled back to the solvent deasphalting process, thus forming a bidirectional integrated process, which overcomes the defect that the de-oiled asphalt is difficult to separate from solvent in the prior art, and the oil component can be extracted in the heavy oil without the need of thermal reaction treatment, thereby guaranteeing the stability of the upgraded products and also increasing the yield of liquid and upgraded oil.

The invention also provides upgraded oil product from a heavy oil process. The upgraded oil product is obtained from processing heavy oil according to the integrated process of the invention and combining the oil components produced during respective processes, wherein the impurities including metal, asphaltenes and so on and coke forming precursors are separated from each other to the maximum extent. In additions, the oil components produced via physical separation have high hydrogen content and the products have good stability.

One aspect of the invention provides a integrated process for processing heavy oil, comprising at least the following processes:

heavy oil, which substantially does not comprise <350° C. atmospheric distillates, is used as feed for solvent deasphalting process in an extraction tower together with extraction solvent, collecting de-asphalted oil and de-oiled asphalt phase including the extraction solvent;

the de-oiled asphalt phase including the extraction solvent is mixed with dispersing solvent and then enters a thermal cracking reactor to undergo thermal cracking process, so as to obtain thermal cracking reaction products and coke, leading out of the thermal cracking reaction products, separating, the solvent, thermal cracking oil and 450° C.+ heavy gas oil;

the solvent separated from the thermal cracking products is recycled back to the solvent deasphalting process, 450° C.+ heavy gas oil is recycled back to the solvent deasphalting process and taken as mixed feed with heavy gas oil;

upgraded oil is obtained through the mixture of the de-asphalted oil and the thermal cracking oil separated from the thermal cracking reaction products.

The heavy oil feedstock in the invention is mainly heavy crude oil (including extra heavy oil) with API gravity less than 20 (its density under the temperature of 20° C. is higher than 0.932 g/cm$^3$) or oil sand bitumen, all of these materials can be used as the feedstock for the integrated process without limiting to any particular production method of the feedstock. The integrated process at least comprises a solvent deasphalting process of the oil feedstock and a thermal cracking process of a de-oiled asphalt phase. In addition, the bidirectional integrated process is realized through the recycle of the extraction solvent and thermal cracking heavy oil.

According to the integrated process in the invention, in order to produce upgraded oil and improve its quality to the maximum extent and hence increase the proportion of straight-run distillation component in the upgraded oil, the integrated process can also include distillation and separation process for the feedstock oil. When boiling range of the distillates included in the oil feedstock is relatively wide, prefractionation can be conducted to separate the straight-run distillate oil. And then the oil components are separated to the maximum extent through solvent extraction deasphalting and thermal cracking of de-oiled asphalt containing the solvent. With the process, the oil components which can be extracted from the heavy oil do not need to be subjected to the thermal reaction, thus removing undesired components to the maximum extent while also improving the stability of the upgraded products.

Specifically, the integrated process in the invention can also comprise: the heavy oil including <350° C. atmospheric distillates are firstly subjected to prefrationation by distillation; collecting distillate oil, and the products from the bottom of the tower is fed to the de-asphalting process, the temperature of the cut point of the prefractionation is 350-565° C. The obtained distillate oil is mixed with the de-asphalted oil and thermal cracking oil so as to form the upgraded oil, or the obtained distillate oil is taken as light oil to be processed to be independently processed in the sequent processes. The prefractionation can comprise atmospheric distillate process or atmospheric plus vacuum distillate process. According to the properties of the oil feedstock and product requirements, the distillation cut point can be controlled and one or a plurality number of distillate oils can be obtained.

According to the integrated process in the invention, distillate oil, de-asphalted oil and thermal cracking heavy gas oil, which are produced in various stages of the process, can be mixed and allocated according to the needed proportion, thus realizing the flexible adjustment of the upgraded oil which is used as feedstock for downstream processing. Particularly, the upgraded oil is further processed with fixed-bed hydrotreating process and hydrotreating upgraded oil can be obtained.

According to embodiments of the integrated process in the invention, two extraction steps can be carried out in the solvent deasphalting process; that it, firstly, a first extraction solvent (it is also called the main solvent) is mixed with the oil feed and then enters into an extraction tower, in which de-asphalted oil and asphalt phase are separated; a second extraction solvent (it is also called as auxiliary solvent) is added into the extraction tower bottom to further extract the asphalt phase, so as to separate the de-asphalted oil, which is discharged from the top of the tower. The obtained de-oiled asphalt phase including extraction solvent is discharged from the bottom of the tower, mixed with a dispersing agent and routed to the thermal cracking process. The first extraction solvent, the second extraction solvent and the dispersing solvent can be selected from C3-C6 alkane or mixed distillates thereof; total mass flow ratio (total mass solvent ratio to oil feed) of the three solvents to the feed of the extraction tower is 3-8:1, wherein solvent distribution proportion is: the first extraction solvent: the second extraction solvent: the dispersing solvent is (0.75-0.93):(0-0.15):(0.02-0.10). As the auxiliary solvent is selectively used, when the auxiliary solvent is used for extraction, the distribution proportion of three parts of the solvents can be: the first extraction solvent: the second extraction solvent: the dispersing solvent is (0.75-0.93):(0.05-0.15):(0.02-0.10).

As for the solvent deasphalting process, the extraction conditions can be determined according to the properties of the heavy oil feedstock and the extraction solvent. In an embodiment, the temperature of the extraction tower can be controlled at 80-250° C., and the extraction pressure can be controlled at 3.5-10 MPa.

According to embodiments of the invention, the above mentioned integrated process also can include: the de-asphalted oil separated from the solvent deasphalting process undergoes adoption of supercritical separation and/or steam stripping to recycle the extraction solvent therefrom. The condition of the supercritical separation for recycling the extraction solvent can be controlled so that the density of the solvent is 0.15-0.20 g/cm$^3$. The other feasible means can also be used for the de-solvent process.

In an embodiment in the invention, the solvent deasphalting process can be carried out as follows: the main solvent and the feed are mixed; the auxiliary solvent is added through the bottom of the extraction tower in counter-current contact with the asphalt phase in the extraction tower to further enhance the extraction for the asphalt. The solvent used in the deasphalting process can be C3-C6 alkane (comprises paraffin, cycloalkane and olefins) and the mixture thereof. C4-C6 paraffin or cycloalkane or olefin and the mixture thereof can be used. The solvent in the de-asphalted oil phase is recycled after being separated with supercritical separation and then steam stripping, and the de-asphalted oil is taken as blending component of the upgraded oil. The de-oiled asphalt phase does not need to undergo solvent removal process. After being discharged from the bottom of the extraction tower, the de-oiled asphalt phase is mixed with a dispersing agent that enhances the dispersion of the de-oiled asphalt, thus resulting in a de-oiled asphalt phase with good flowability.

In the process according to an embodiment in the invention, the first extraction solvent (main solvent) and the second extraction solvent (auxiliary solvent) are used for extracting and separating the heavy oil into the de-asphalted oil and the de-oiled asphalt phase. The dispersing solvent is used for enhancing the dispersion of the de-oiled asphalt and improving its flowability. Therefore, in theory, these three solvents can be respectively selected according to their functions and effects. In practice, these three solvents can be identical; for example, all can be C3-C6 alkane (comprises paraffin or cycloalkane) and the mixture thereof.

As for the technology of deep processing of the heavy oil, in Chinese invention patents No. ZL 01141462.6 and No. ZL 200510080799.0, the related American invention U.S. Pat. No. 7,597,797B2, Canada invention patent No. CIP 2,524,995 and French invention patent No. FR 2888245 of the inventors of the invention, a method of deeply separating the heavy oil is proposed. With the solvent deasphalting technology, the de-asphalted oil is obtained to the maximum extent from the heavy oil. Meanwhile, with coupling technology, the de-oiled asphalt is subjected to granulation, thus solving the problems that the asphalt with high softening point is difficult to be transported and separated with solvent. In additions, the obtained asphalt particles can be made into slurry to be used as fuel or feedstock for synthesis gas produced by gasification. Particularly, as the solvent deasphalting technology and the de-asphalted oil purification technology have been explained in details in the abovementioned patents, the related content of these parts is herein incorporated by reference and taken as the supplemental instruction for the technical solution of the present invention.

With the further research based on the abovementioned patent in the prior art, the inventors of this invention discover that the solvent-containing de-oiled asphalt phase, without separating the solvent, can be further mixed with proper dispersing solvent and then directly introduced into a thermal cracking reactor. With its good flowability and dispersing properties, the solvent-containing de-oiled asphalt phase is dispersed into liquid drops in a thermal cracking reactor (the de-oiled asphalt from the extraction tower is dispersed into the thermal cracking reactor in the form of liquid drops by mist spray) and mixed with high temperature media. The solvent is evaporated with heat from the process, the de-oiled asphalt undergoes thermal reactions to produce reaction products, thus not only solving the problem of separation of asphalt from solvent, but also overcoming the problem that the asphalt is difficult to be transported because of its flowability, while through thermal reaction the conversion of asphalt to light fractions is realized, further improving the yield of the upgraded oil.

The specific operations of the thermal cracking process technology in the invention can be as follows: the de-oiled asphalt including the extraction solvent is dispersed and injected into a thermal cracking process reactor, to contact with the heat providing high temperature media, so as to obtain thermal cracking products. The heat providing high temperature media comprises high-temperature hydrocarbon vapor, high-temperature steam, high-temperature coke particles which are partially burned or inorganic particles loaded with burned coke such as bitumen sand, quartz sand. The temperature of both the high-temperature hydrocarbon vapor and the high-temperature steam can be 500-600° C. The high-temperature coke particles which are partially burned or the inorganic particles loaded with burned coke is the coke discharged from the thermal cracking reaction or the coke attached to the inorganic particles, which is recycled back to the thermal cracking reactor as heat providing media after being burned to 600-750° C.

According to the integrated process in the invention, the de-oiled asphalt phase including the extraction solvent, which is separated from the solvent deasphalting process, is atomized, dispersed and injected into the thermal cracking reactor (a reaction tower) under the action of the pressure of the extraction tower. Under the action of the dispersing solvent, the asphalt is dispersed and then contacts with the high-temperature media to conduct thermal reaction. The average reaction temperature of the thermal cracking can be controlled to be 450-550° C., for example, 470-530° C. The gas reaction products and the coke are obtained, wherein the coke is discharged from the bottom of the reactor. The solvent in asphalt phase is vaporized in the thermal cracking reaction tower and then flows out of the top of reaction tower together with the products. The discharged gas reaction products are separated and gas, solvent, thermal cracking oil and 450° C.+ heavy gas oil can be obtained. The heavy gas oil is recycled and used as the feed of solvent de-asphalted process, and the solvents are recycled back to the solvent deasphalting process to be used.

The heat providing high-temperature media of the thermal reaction tower can be obtained from two ways: one way is the high-temperature steam or high-temperature hydrocarbon vapor which is heated to be 500-600° C., and the other way is that the product coke particles or the coke loaded on the inorganic particles are partially burned. The temperature of the produced particles can be 600-750° C. These particles are recycled back to the thermal reactor and taken as heat source, so that the resources can be fully used.

When the asphalt in the asphalt phase from the solvent deasphalting process undergoes thermal reaction in the thermal cracking reactor, at the same time, the solvent in the asphalt phase is evaporated and flows out of the tower together with the thermal reaction products. And then, the thermal cracking oil, the solvent and the heavy gas oil (it can be regarded as the heaviest distillate of the liquid products of the thermal cracking reaction) can be separated. The separation method can be as follows: the thermal cracking reaction products are firstly absorbed by a heavy oil feedstock; 450° C.+ heavy gas oil is separated, and the gas, the solvent and the thermal cracking oil are further fractionated and separated. The separated heavy gas oil is recycled back to the solvent deasphalting process as the feed and the impurities in the 450° C.+ heavy gas oil, such as asphaltene, heavy resin and so on are further removed. Furthermore, through further solvent extraction, the extractable oil components in the 450° C.+ heavy gas oil are separated. The solvent which is discharged together with the thermal cracking products is recycled back to the deasphalting process for recycle through a specially arranged solvent recycling path. The thermal cracking oil is obtained as part of the upgraded oil. Considering the comprehensive factors in the actual process, when the thermal cracking reaction products are separated, 450° C.+ heavy gas oil (for example, the distilled oil with boiling point higher than 450° C.-470° C.) is controlled to be recycled back to the solvent deasphalting process, thus not only being in favor of increasing the total yield of the oil but also achieving the purposes of controlling the thermal cracking oil and finally upgrading the oil quality. As the oil components have been extracted and separated sufficiently in the previous process, the quantity of the heavy gas oil is reduced. Through controlling the flow quantity of the heavy oil feedstock that used for absorption, this portion of the distillates can be stably absorbed and fed back to the solvent deasphalting process. As for the heavy oil feedstock mentioned here, it can be obtained as the heavy oil which is to be processed with the solvent deasphalting process.

The obtained distillate oil, the de-asphalted oil and the thermal cracking oil are mixed according to the provided proportion, thus obtaining the upgraded oil. Generally, the distillate oil is the distillates of light gas oil and straight-run gas oil. According to their gravity and actual production, the distillates can be taken as a processed product and directly stored and transported to the downstream process for processing. Therefore, in the production, it is also possible to only mix the de-asphalted oil and the thermal cracking oil or part of the distillate oil to form the upgraded oil. As the undesired components, such as the asphalt with high softening point, asphaltenes, coke forming precursors and so on, are removed to the maximum extent with the integrated process in the invention, in addition, as the proportions of the straight-run distillate oil and the extraction oil are relatively high, the stability of the upgraded oil is significantly increased.

The upgraded oil provided in the invention can be processed into the hydro-upgrading oil with the adoption of the conventional fixed bed hydrotreating process technology. The operation difficulty and severity of the hydrotreating process can be obviously reduced, for example, the specific operation parameters can be as follows: the temperature of the hydrotreating process is 360-450° C.; the pressure is 6-20 MPa, the ratio of hydrogen to oil (volume ratio) is 200-1200:1, and the space velocity of the reactor is 0.3-3.0 $h^{-1}$.

In summary, the invention designs and proposes a scientific and reasonable integrated process. With the integrated process, the extractable oil components in the heavy oil is extracted out without undergoing thermal reaction; the oil components are separated and collected to the maximum extent during the physical process, thus beneficial for guaranteeing the stability of the upgraded oil products. In addition, as only the residual extracted asphalt is subjected to the thermal reaction, thus facilitating the total yields of the coke and the gas to be lower than those of the process in the prior art and hence increasing the yield and the quality of the upgraded oil. In additions, with the integrated process in the invention, the upgraded oil has relatively increased API gravity, significantly reduced carbon residue value, C7 asphaltene and metal content, the removal of the asphaltene high than 96%, and removal of metallic nickel +Vanadium reaches 80-90%. That is, the undesired components of the heavy oil: the asphalt with high softening point as well as the metals, asphaltene and coke forming precursor which are included in the asphalt, are removed significantly, thus the upgraded oil is better meeting the feed specifications of the conventional fixed-bed hydrotreating process, facilitating the upgraded oil to be treated in hydrotreating process to have relatively high quality and volume yield, and significantly improved quality.

With the integrated process in the invention, the heavy oil feedstock from different sources can be processed to produce the upgraded oil; for example, if Canada oil sand bitumen and Venezuela extra heavy oil which typically have API lower than 10 are processed, the yields of their upgraded oils can reach 88.5 wt % (92 v %) and 80.8 wt % (85 v %); the quality of the upgraded oil can be improved. its API gravity can be increased more than 6 units; more than 96% of C7 asphaltene can be removed; the residue carbon and metals are significantly reduced, and the removal of Ni+V can be 80-90%. The upgraded oil from heavy oil feedstock can be processed using the conventional fixed-bed hydrotreating technology, thus significantly reducing the operation difficulty and severity of the hydrotreating process and reducing catalyst toxicosis deactivation and coke forming As for the hydrotreating upgraded oil: API is 26; sulfur content is lower than 0.3 wt %; asphaltene content is lower than 0.1 wt %, carbon residue is 0.8-2.1 wt %, and content of Ni+V are lower than 3 μg/g, thus meeting the feed specifications of catalytic cracking.

BRIEF DESCRIPTION OF THE DRAWING(S)

FIG. 1 is a process flow diagram of an example of a integrated process of processing heavy oil according to an embodiment of the invention.

The reference numbers in the drawings can both represent devices and processes realized by the devices: 1: Atmospheric Distillation tower/Atmospheric Distillation; 2: Vacuum Distillation Tower/Vacuum Distillation; 3: Extraction Mixer/Mixing; 4. Extraction Tower/Solvent Deasphalting Process; 5: Supercritical Solvent Recovery Device/Supercritical Solvent Recovery; 6: Thermal Reaction Reactor/Thermal Cracking Reaction; 7: Separator/The Separation Of Cracking Reaction Products; 8: Fixed Bed/Fixed Bed Hydrotreating Process.

DETAILED DESCRIPTION

With reference to embodiments, the implementation and characteristics of the invention are described in details below, so that the spirit and effects of the invention can be more accurately understood. The embodiments are exemplary and not intended to limit the implementation scope of the invention.

Referring to FIG. 1, a integrated process for processing heavy oil provided in an embodiment of the invention is described in the followings:

Prefractionation of the heavy oil feedstock is firstly carried out. It can be subjected to atmospheric distillation or atmospheric/vacuum distillation according to the properties of oil feedstock, with the cut point temperature of distillates of 350-565° C. The oil feedstock is distilled in an atmospheric distillation tower 1 or a vacuum distillation tower 2. The distillate oil is discharged from the top of the distillation tower. The substances from the bottom of the distillation tower are mixed with a main solvent (an extraction mixer 3 can be arranged here) as feed material and, then, enters into an extraction tower 4 to separate de-asphalted oil and asphalt phase. The asphalt phase is further extracted by an auxiliary solvent added from the bottom of the extraction tower 4 if desirable. The de-asphalted oil which is extracted during the second extraction is discharged from the top of the extraction tower. The obtained de-oiled asphalt including the extraction solvent is discharged from the bottom of the extraction tower, and mixed with a dispersing solvent in a transfer pipeline, and enters into a thermal cracking tower 6 to conduct thermal reaction.

The prefractionation of the heavy oil feedstock may not be a necessary step, and whether conducting the prefractionation depends on the properties of the feedstock. For example, a heavy oil feedstock which does not contain lower than 350° C. distillate can omit the prefractionation of atmospheric distillation/vacuum distillation and be directly subjected to with the solvent deasphalting process as the feed material of the extraction tower 4. The other conditions are that: the atmospheric distillation 1 and the vacuum distillation 2 also can be selectively used according to the properties of the feedstock oil; that is, only the atmospheric distillation, or only vacuum distillation, or both of the two processes are carried out.

The de-oiled asphalt discharged from the bottom of the extraction tower without separating the solvent is directly introduced into thermal cracking 6 after being mixed with a proper dispersing solvent. As there is certain pressure in the extraction tower 4, the discharged asphalt enters into thermal cracking tower 6 in the form of mist spray. With good flowability and dispersing properties, the asphalt is dispersed in the thermal cracking tower 6 (it is also called as a thermal cracking reactor) in the form of liquid droplets and mixed with high-temperature media, with the heat of which, the de-oiled asphalt undergoes thermal reaction and reaction products are obtained. The solvents (comprising extraction solvent and dispersing solvent) entering into the thermal cracking tower 6 together with the asphalt are evaporized and flow out of the thermal cracking tower together with the thermal reaction products. The coke produced through the thermal reaction is discharged from the bottom of the thermal cracking reactor, and the reaction products flow out of the top of the thermal cracking tower and are transported into a separator 7 to carry out heat-exchange condensing separation. At the same time, part of the heavy oil feedstock (for a process where atmospheric distillation/vacuum distillation is not carried out), or part of substances from the bottom of the distillation tower that have been subjected to distillate cut is routed the separator 7. The reaction products are absorbed at the bottom. The circulation amount of the heavy oil feedstock or the substances from the distillation bottom of the tower, or directly from the feedstock is controlled. The heavy gas oil in the reaction products is separated, circulated, mixed with the feed material and recycled back to the extraction tower 4, thus extracting and removing impurities such as asphaltene, heavy resin and so on (these impurities enter the thermal cracking tower together with the asphalt phase and eventually discharged together with the coke). The oil components produced in the thermal reaction are also further extracted into the de-asphalted oil. Gas, solvent and thermal cracking oil with the boiling point lower than 450° C. are obtained after the remaining thermal reaction products further go through heat exchange, condensation and separation. The gas is separated and purified, the sulfurous gas (for example, $H_2S$) is recovered as gas products, and the purified gas is discharged. The solvent discharged together with the thermal cracking reaction products is cooled, separated, discharged out of the separator 7 and recycled back to the solvent deasphalting process to be recycled. The thermal cracking oil is discharged from the bottom of the separator 7.

The de-asphalted oil discharged from the top of the extraction tower 4 enters a supercritical solvent recycling device 5 and undergoes supercritical separation and then steam stripping to recover extraction solvent contained therein, and the extraction solvent is recycled back to the solvent deasphalting process to be recycled. The supercritical separation with which the extraction solvent is recovered is controlled under the condition that the density of the solvent is 0.15-0.20 g/cm$^3$. The purpose of the supercritical separation process is to purify the de-asphalted oil and fully recover the extraction solvent at the same time.

The distillate oil, the de-asphalted oil and the thermal cracking oil, which are formed through the abovementioned processes, are mixed to form the upgraded oil provided in the invention. Compared with the heavy oil feedstock, the API of the upgraded oil is significantly increased, and the quality and flowablilty are greatly improved. According to the design requirements, the mixed proportions of the respective oil components can be changed, thus realizing the flexible adjustment and control for the upgraded oil. Or the destination of the distillate oil components can be changed, thus, part or all of the distillate oil components also can independently be taken as oil feedstock for subsequent refining processes and not mixed into the upgraded oil.

In FIG. 1, the upgraded oil obtained through the abovementioned integrated process also can be introduced into a fixed bed hydrotreating process 8 so as to obtain hydrotreating upgraded oil.

The integrated processes adopted in the following embodiments all can refer to the abovementioned processes. According to the requirements of production objectives and design, the specific processes and their operating parameters can vary; however, they all fall within the scope of the invention and can be understood by those skilled in the art without any uncertainty.

EXAMPLE 1

Canada Cold Lake oil sand bitumen: API: 10.2; sulfur content: 4.4 wt %; Conradson Carbon Residue (CCR): 13.2 wt %; C7 asphaltene: 10.0 wt %; content of Ni and V: 69 μg/g and 182 μg/g, respectively.

The oil sand bitumen is firstly subjected to atmospheric distillation, 200-350° C. light gas oil (15.0 wt %) and substances (residual oil) from the bottom of the atmospheric tower with boiling point higher than 350° C. are obtained.

The substances from the bottom of the atmospheric tower undergo a solvent de-asphalting process with iso-butane (iC4) as extraction solvent. Firstly, the substances from the bottom of the atomsphetic distillation tower as feed material are mixed with a main solvent and fed into an extraction tower 4 at the middle part or the upper part of the extraction tower. An auxiliary solvent is introduced into the extraction tower at the lower part of the extraction tower and undergoes countercurrent contact with de-oiled asphalt to enhance extraction to the asphalt phase which has been extracted with the main solvent: the temperature at the bottom of the extraction tower is about 120° C.; the temperature at the top of the extraction tower is about 130° C.; extraction pressure is about 4.3 MPa. The de-oiled asphalt is mixed with iso-butane (iC4) again as a dispersing solvent after being discharged from the bottom of the extraction tower, thus the asphalt phase is introduced into a thermal cracking tower 6 under enhanced dispersing state. During the solvent deasphalting process, the ratio of the total mass solvents to oil feedstock is 4.6:1; the distribution proportion of the solvents is: main solvent: auxiliary solvent: dispersing solvent=0.761:0.217:0.022.

The solvent in the de-asphalted oil discharged from the extraction tower 4 is firstly recycled under supercritical conditions of 4.2 MPa and 160° C. (the solvent density is 0.129 g/cm$^3$ at this time). The remaining solvent is further recycled by steam stripping.

The de-oiled asphalt phase discharged from the extraction tower 4, containing the extraction solvent and mixed with the dispersing solvent, is dispersed into the thermal cracking tower 6 by mist spray. The fed high-temperature heat providing media is high-temperature steam with a temperature of 570° C. The average temperature of the thermal cracking reaction is 470° C., at this time, thermal reactions of the de-oiled asphalt occur. The formed solid coke is discharged from the bottom of the thermal cracking tower 6, the solvent in the asphalt phase together with the reaction products flow out form the top of the thermal cracking tower 6 and enters a separator 7. Meanwhile, a proper amount of the above mentioned substances from the bottom of the atmospheric tower is routed into the separator 7, thus heavy gas oil distillate with boiling point higher than 450° C. is absorbed and separated from the thermal reaction products, and recycled back to solvent deasphalting process 4 to be mixed with feed material and enters the extraction tower 4 to continue extracting and removing the asphaltene and heavy resin therein. Gas, solvent and thermal cracking oil with boiling point lower than 450° C. are obtained after the remaining thermal reaction products are further subjected to heat exchange, condensation and separation. The solvent is recycled back to the deasphalting process 4 to be mixed with the main solvent and continue being used as solvent. The gas, which is purified by removing $H_2S$, is recovered as gaseous product. The thermal cracking oil is led out and mixed with the light gas oil distillate obtained from atmospheric distillation and the de-asphalted oil to obtain upgraded oil, which serves as oil feedstock for subsequent processing. Through tests, the upgraded oil has: yield: 81.36 wt % (85.41 v %); API: 18.1; carbon residue: 3.56 wt %; sulfur content: 3.51 wt %; content of Ni and V: 8.4 μg/g and 20.8 μg/g; yields of by-products gas and coke: 4.95 wt % and 13.68 wt %.

The upgraded oil may further undergo fixed-bed hydrotreating process 8 under the conditions: hydrotreating process temperature: 385° C.; pressure: 9 MPa; hydrogen-oil ratio (volume ratio): 600:1; space velocity of the reactor: 2.5 $h^{-1}$. The obtained hydrotreating upgraded oil has: oil yield: 78.14 wt % (86.94 v %); API gravity: 27.0; sulfur content: 0.25 wt %; carbon residue: 1.11 wt %; asphaltene: <0.05 wt %; content of Ni and V: 0.8 μg/g and 0.9 μg/g.

Distribution and Properties of Feedstock and Products of Upgraded Oil Are as Follows:

| Feedstock wt %(v %) | API Gravity | | S wt % | Carbon Residue wt % | C7Asphaltene wt % | Ni μg/g | V μg/g |
|---|---|---|---|---|---|---|---|
| 100 | 10.2 | | 4.4 | 13.2 | 10 | 65 | 182 |
| | C5+ Oil Yield | | Products Distribution wt % | | | | |
| | wt % | Vol % | C5-200° C. | 200-350° C. | 350-500° C. | 500° C.+ | |
| Upgraded Oil | 81.36 | 85.41 | 4.00 | 24.49 | 29.19 | 42.32 | |
| | API | | S wt % | Carbon Residue wt % | C7Asphaltene wt % | Ni μg/g | V μg/g |
| | 18.1 | | 3.51 | 3.56 | 0.12 | 8.4 | 20.8 |
| | | | Products Distribution wt % | | | | |
| | C5+ Oil Yield | | Initial Boiling | | | | |
| | wt % | Vol % | Point-200° C. | 200-350° C. | 350-500° C. | 500° C.+ | |
| Hydrotreating Upgraded Oil | 78.14 | 86.94 | 17.92 | 17.70 | 43.69 | 20.69 | |
| | API Gravity | | S wt % | Carbon Residue wt % | C7Asphaltene wt % | Ni μg/g | V μg/g |
| | 27.0 | | 0.25 | 1.11 | <0.05 | 0.8 | 0.9 |

Through the above integrated processes, the upgraded oil also can be obtained through mixing only the thermal cracking oil and the de-asphalted oil, and the upgraded oil and the light gas oil distillate from atmospheric distillate are separately stored for subsequent process, or the quality of the upgraded oil can also be adjusted and controlled through the control of proportion of the light gas oil distillate mixed therein so as to flexibly adjust and control the increase in API of the upgraded oil. All of the following examples can be processed in the same way.

EXAMPLE 2

Canada Athabasca oil sand bitumen: API: 8.9; sulfur content: 4.60 wt %; Conradson carbon residue (CCR): 13.0%; C7 asphaltene content: 11.03 wt %; content of Ni and V: 69 μg/g and 190 μg/g.

Through atmospheric distillation, 12.04 wt % of 200-350° C. light gas oil distillate is obtained; the yield of substances (residual oil) from the bottom of the atmospheric tower is 87.96 wt %.

The substance from the bottom of the atmospheric tower is subjected to with solvent de-asphalting process with nC4-nC5 mixed solvent as extraction solvent. The components of the extraction solvents are: nC4:nC5=50:50 (wt/wt). The operation of the solvent deaphalting process is the same as described in Example 1. However, the mass ratio of the total solvent to oil feedstock is: 3.95:1; main solvent: auxiliary solvent: dispersing solvent=0.759:0.203:0.038; the temperature at the bottom of the extraction tower: 140° C.; the temperature at the top of the extraction tower: 160° C.; extraction pressure: 5.0 MPa.

The solvent in the de-asphalted oil discharged from the extraction tower 4 is firstly recovered under supercritical conditions of 4.9 MPa and 196° C. (the solvent density is 0.220 g/cm$^3$ at this time). The remaining solvent is further recovered by steam stripping.

The de-oiled asphalt phase discharged from the extraction tower 4, containing the extraction solvent and mixed with the dispersing solvent, is dispersed into a thermal cracking tower 6 by mist spray. The thermal cracking reactions occur after the de-oiled asphalt phase contacts with 720° C. hot coke, and the average reaction temperature is 490° C. At this time, the de-oiled asphalt undergoes thermal reactions, and the product coke is discharged from the bottom of the thermal cracking tower 6. The solvent in the asphalt phase together with the reaction products flows out of the top of the thermal cracking tower 6 and enters into a separator 7. Meanwhile, appropriate amount of the abovementioned substances from the bottom of the atmospheric tower is routed to the separator so as to facilitate heavy gas oil with boiling point higher than 450° C. to be absorbed and separated from the thermal reaction products, and recycled back to solvent deasphalting process 4 to be mixed with feed materials, and enters into the extraction tower 4. The gas, solvent and thermal cracking oil with boiling point lower than 450° C. are obtained after the remaining thermal reaction products being distilled and separated. The gas, which is purified by removing $H_2S$, is recovered. The solvent is recycled back to the deasphalting process and continues to be used as solvent (it can be used as main solvent, auxiliary solvent and/or dispersing solvent). The thermal cracking oil is led out and mixed with the above light gas oil distillate and the de-asphalted oil to obtain the upgraded oil. With the tests, the upgraded oil is: oil yield: 84.07t % (88.64 v %); API gravity: 16.5; carbon residue: 4.71 wt %; sulfur content: 3.55 wt %; content of Ni and V: 12.9 μg/g and 29.3 μg/g. Yields of the by-products gas and the coke: 4.15 wt % and 11.78 wt %.

The abovementioned upgraded oil is further undergo with fixed-bed hydrotreating process 8 and hydrotreating upgraded oil can be obtained, wherein the hydrotreating process is conducted under the conditions: temperature: 395° C.; reaction pressure: 10 MPa; hydrogen-oil ratio (volume ratio): 600:1; space velocity of the reactor: 1.8 h$^{1}$; the yield of hydrotreating upgraded oil: 80.79 wt % (90.44 v %); API gravity: 25.7; sulfur content: 0.23 wt %; carbon residue: 1.71 wt %; asphaltene: <0.05 wt %; content of Ni and V: 1.1 μg/g and 0.9 μg/g.

Distribution and Properties of Raw Material and Products of Upgraded Oil Are as Follows:

| Feedstock wt %(v %) | API Gravity | | S wt % | Carbon Residue wt % | C7Asphaltene wt % | Ni μg/g | V μg/g |
|---|---|---|---|---|---|---|---|
| 100 | 8.9 | | 4.6 | 13 | 11.03 | 65.4 | 192.6 |
| | | | Products Distribution wt % | | | | |
| | C5+ Oil Yield | | Initial Boiling | | | | |
| | wt % | vol % | Point-200° C. | 200-350° C. | 350-500° C. | 500° C.+ | |
| Upgraded Oil | 84.07 | 88.64 | 2.30 | 17.36 | 39.94 | 40.40 | |
| | API | | S wt % | Carbon Residue wt % | C7Asphaltene wt % | Ni μg/g | V μg/g |
| | 16.5 | | 3.55 | 4.71 | 0.14 | 12.9 | 29.3 |
| | | | Products Distribution wt % | | | | |
| | C5+ Oil Yield | | Initial Boiling | | | | |
| | wt % | vol % | Point-200° C. | 200-350° C. | 350-500° C. | 500° C.+ | |
| Hydrotreating Upgraded Oil | 80.79 | 90.44 | 13.72 | 15.64 | 50.88 | 19.76 | |
| | API Gravity | | S wt % | Carbon Residue wt % | C7Asphaltene wt % | Ni μg/g | V μg/g |
| | 25.7 | | 0.23 | 1.71 | <0.05 | 1.1 | 0.9 |

EXAMPLE 3

Canada Athabasca oil sand bitumen: API: 8.9; sulfur content: 4.6 wt %; Conradson carbon residue (CCR): 13.0%; C7 asphaltene content: 11.4 wt %; content of Ni and V: 65.4 μg/g and 192.6 μg/g.

Through atmospheric and vacuum distillation, 12.04 wt % of 200-350° C. light gas oil distillate and 32.75 wt % of 350-500° C. straight-run gas oil are obtained; the yield of the substances from the bottom of a vacuum tower (residual oil with boiling point higher than 500° C.) is 55.21 wt %.

The residual oil from the bottom of the vacuum tower is subjected to deasphalting process with n-pentane (nC5) being used as extraction solvent. The specific operation is as described in Example 1. The mass ratio of total solvent to oil feedstock is 3.7:1, wherein the main solvent: auxiliary solvent: dispersing solvent is 0.811:0.135:0.054; the temperature of the bottom of the extraction tower: 160° C.; the temperature of the top of the tower: 170° C.; extraction pressure: 5.5 MPa.

The solvent in the de-asphalted oil discharged from the extraction tower 4 is firstly recovered under supercritical conditions of 5.4 MPa and 240° C. (the solvent density is 0.196 g/cm$^3$ at this time). The remaining solvent is further recovered by steam stripping.

The de-oiled asphalt phase, discharged from the extraction tower 4, including the extraction solvent and mixed with dispersing solvent, is dispersed into a thermal cracking tower 6 by mist spray. The thermal cracking reactions occur after the de-oiled asphalt phase contacts with 700° C. thermal bitumen sand. The average temperature of the reaction reaches 500° C. At this time, the de-oiled asphalt undergoes thermal reaction, and the formed solid coke is discharged from the bottom of a thermal cracking tower 6. The solvent in the asphalt phase together with the reaction products flow out of the top of the thermal cracking tower 6 and is introduced into a separator 7. Meanwhile, appropriate amount of the abovementioned substances from the bottom of the vacuum tower is routed the separator so as to facilitate heavy gas oil with boiling point higher than 470° C. to be absorbed and separated from the thermal reaction products, and recycled back to solvent deasphalting process 4 to be mixed with feed, and entered into the extraction tower 4 to be extracted continuously. The gas, solvent and thermal cracking oil with boiling point lower than 470° C. are obtained after the remaining thermal reaction products are further distilled and separated. The gas, which is purified by removing $H_2S$, is recovered. The solvent is recycled back to the deasphalting process 4 and continues to be used as solvent. The thermal cracking oil is led out and mixed with the above light gas oil distillate and the de-asphalted oil to obtain upgraded oil. Through tests, the upgraded oil: yield: 86.62 wt % (90.4 v %); API: 15.0; carbon residue: 4.91 wt %; sulfur content: 3.73 wt %; content of Ni and V: 16.9 μg/g and 46.5 μg/g; yields of gas and coke which are by-products: 3.07 wt % and 10.3 wt %.

The abovementioned upgraded oil is further subjected to fixed-bed hydrotreating process 8 and hydrotreating upgraded oil can be obtained. The hydrotreating process is conducted under the conditions: temperature: 400° C.; reaction pressure: 11 Mpa; hydrogen-oil ratio (volume ratio): 800:1; space velocity of its reactor: 1.5 h$^{-1}$. The obtained hydrotreating upgraded oil: yield: 83.41 wt % (93.80 v %); its API gravity: 26.4; sulfur content: 0.24 wt %; carbon residue: 1.78 wt %; asphaltene: 0.08 wt %; content of Ni and V: 0.8 μg/g and 1.4 μg/g.

Distribution and Properties of Raw Material and Products of Upgraded Oil Are as Follows:

| Feedstock wt %(v %) | API Gravity | | S wt % | Carbon Residue wt % | C7Asphaltene wt % | Ni μg/g | V μg/g |
|---|---|---|---|---|---|---|---|
| 100 | 8.9 | | 4.6 | 13 | 11.4 | 65.4 | 192.6 |
| | | | Products Distribution, wt % | | | | |
| | C5+ Oil Yield | | Initial Boiling | | | | |
| | wt % | Vol % | Point-200° C. | 200-350° C. | 350-500° C. | 500° C.+ | |
| Upgraded Oil | 86.62 | 90.40 | 2.49 | 17.66 | 39.31 | 40.54 | |
| | API | | S wt % | Carbon Residue wt % | C7Asphaltene wt % | Ni μg/g | V μg/g |
| | 15.0 | | 3.73 | 4.91 | 0.25 | 16.2 | 46.5 |
| | | | Products Distribution wt % | | | | |
| | C5+ Oil Yield | | Initial Boiling | | | | |
| | wt % | Vol % | Point-200° C. | 200-350° C. | 350-500° C. | 500° C.+ | |
| Hydrotreating Upgraded Oil | 83.41 | 93.80 | 13.53 | 15.72 | 51.00 | 19.76 | |
| | APIGRAVITY | | S wt % | Carbon Residue wt % | C7Asphaltene wt % | Ni μg/g | V μg/g |
| | 26.4 | | 0.24 | 1.78 | 0.08 | 1.5 | 1.4 |

The atmospheric and vacuum distillation oil (light gas oil distillates and straight-run vacuum gas oil), which are obtained through the abovementioned integrated process, also can be stored independently and used as feed in subsequent process, or mixed with thermal cracking oil in controlled proportion according to requirements to become the upgraded oil.

EXAMPLE 4

Canadian oil sand bitumen, which has the same properties as that of Example 3.

The oil sand bitumen is firstly subjected to atmospheric and vacuum distillation, and 12.04 wt % 200-350° C. light gas oil distillate; 28.75 wt % of 350-524° C. straight-run vacuum gas oil are obtained; the yield of the substances from the bottom of the vacuum tower (vacuum residual oil) is 50.5 wt %.

With the mixed solvent of n-pentane (nC5) and cyclopentane being used, VTB is subjected to with deasphalting process. The specific operation is as described in Example 1. The composition of extraction solvent is: n-pentane:cyclopentane is 0.9 (wt):0.1 (wt), the mass ratio of the total solvent to oil feedstock is 4.3:1, wherein the main solvent: auxiliary solvent: dispersing solvent=0.698:0.233:0.070; the temperature of the bottom of the extraction tower: 160° C.; the temperature of the top of the tower: 170° C.; extraction pressure: 5.5 MPa.

The solvent in the de-asphalted oil discharged from the extraction tower 4 is firstly recycled under supercritical conditions of 4.85 MPa and 230° C. (the solvent density is 0.195 g/cm$^3$ at this time). The remaining solvent is further recycled by steam stripping.

The de-oiled asphalt phase, discharged from the extraction tower 4, including the extraction solvent and mixed with dispersing solvent, is dispersed into a thermal cracking tower 6 by mist spray. The temperature of the de-oiled asphalt reaches 505° C. after it contacts with hot coke, and then thermal reaction occurs to produce reaction products. The produced solid coke is discharged from the bottom of a thermal cracking tower 6. The solvent in the asphalt phase together with the reaction products flow out of the top of the thermal cracking tower 6 and into a separator 7. Meanwhile, appropriate amount of the abovementioned substances from the bottom of the tower is routed the separator 7 so as to facilitate heavy gas oil with boiling point higher than 500° C. to be absorbed and separated from the thermal reaction products, and recycled back to solvent deasphalting process 4 to be mixed with residual oil feed, and entered into the extraction tower 4 to be extracted continuously. The gas, solvent and thermal cracking oil with the boiling point lower than 500° C. are obtained after the remaining thermal reaction products are further distilled and separated. The gas, which is purified by removing $H_2S$, is recovered. The solvent is recycled back to the deasphalting process 4 and continues to be taken as solvent. The upgraded oil is obtained through mixing the thermal cracking oil, straight-run light gas oil and vacuum gas oil and the de-asphalted oil. Through tests, the upgraded oil: yield: 88.54 wt % (91.96 v %); API: 14.3; carbon residue: 5.71 wt %; sulfur content: 3.84 wt %; content of Ni and V: 20.0 μg/g and 57.9 μg/g; yields of by-products gas and coke: 2.48 wt % and 8.98 wt %.

The above upgraded oil is further subjected to fixed-bed hydrotreating process 8 and the hydrotreating upgraded oil is obtained. The hydrotreating process is conducted under the conditions: temperature: 400° C.; reaction pressure: 13 Mpa; hydrogen-oil ratio (volume ratio): 1000:1; space velocity of reactor: 1.0 h$^{-1}$. The obtained hydrotreating upgraded oil: yield: 85.16 wt % (95.46 v %); API gravity: 25.9; sulfur content: 0.26 wt %; carbon residue: 2.08 wt %; asphaltene: 0.08 wt %; content of Ni and V: 1.5 μg/g and 1.2 μg/g.

Distribution and Properties of Raw Material and Products of Upgraded Oil Are as Follows:

| Feedstock wt %(v %) | API Gravity | S wt % | Carbon Residue wt % | C7Asphaltene wt % | Ni μg/g | V μg/g |
|---|---|---|---|---|---|---|
| 100 | 8.9 | 4.6 | 13 | 11.4 | 65.4 | 192.6 |

| | C5+ Oil Yield | | Products Distribution wt % | | | |
|---|---|---|---|---|---|---|
| | | | Initial Boiling | | | |
| | wt % | Vol % | Point-200° C. | 200-350° C. | 350-500° C. | 500° C.+ |
| Upgraded Oil | 88.54 | 91.96 | 1.86 | 16.34 | 38.15 | 43.65 |

| API Gravity | S wt % | Carbon Residue wt % | C7Asphaltene wt % | Ni μg/g | V μg/g |
|---|---|---|---|---|---|
| 14.3 | 3.84 | 5.71 | 0.27 | 20.0 | 57.9 |

| | C5+ Oil Yield | | Products Distribution wt % | | | |
|---|---|---|---|---|---|---|
| | | | Initial Boiling | | | |
| | wt % | Vol % | Point-200° C. | 200-350° C. | 350-500° C. | 500° C.+ |
| Hydrotreating Upgraded Oil | 85.16 | 95.46 | 12.90 | 15.04 | 50.76 | 21.30 |

| API Gravity | S wt % | Carbon Residue wt % | C7Asphaltene wt % | Ni μg/g | V μg/g |
|---|---|---|---|---|---|
| 25.9 | 0.26 | 2.08 | 0.08 | 1.5 | 1.2 |

EXAMPLE 5

Venezuela extra heavy oil: API: 8.7; sulfur content: 4.0 wt %; Conradson carbon residue (CCR): 15.1%; the content of Ni and V: 111 μg/g and 487 μg/g.

The extra heavy oil is firstly subjected to atmospheric and vacuum distillation, and 11.24 wt % of 200-350° C. light gas oil distillate; 23.44 wt % of 350-524° C. vacuum gas oil distillate are obtained; the yield of the substances from the bottom of the vacuum tower with boiling point higher than 500° C. is 65.32 wt %.

With n-pentane (nC5) being used as extraction solvent, the substances from the bottom of the vacuum tower is subjected to deasphalting process. The specific operation is as described in Example 1. The mass ratio of total solvent to oil feedstock: 4:1, wherein the main solvent: auxiliary solvent: dispersing solvent=0.714:0.238:0.048; the temperature of the bottom of the extraction tower: 170° C.; the temperature of the top of the tower: 180° C.; extraction pressure: 5.0 MPa.

The solvent in the de-asphalted oil discharged from the extraction tower 4 is firstly recovered under supercritical conditions of 4.9 MPa and 250° C. (the solvent density is 0.170 g/cm$^3$ at this time). The remaining solvent is further recovered by steam stripping.

The de-oiled asphalt phase, discharged from the extraction tower 4, including the extraction solvent and mixed with dispersing solvent, is dispersed into a thermal cracking tower 6 by mist spray. The temperature of the de-oiled asphalt reaches 500° C. after contacting with hot coke, and then thermal reaction occurs to produce reaction products. The produced solid coke is discharged from the bottom of the thermal cracking tower 6. The solvent in the asphalt phase together with the reaction products flow out of the top of the thermal cracking tower 6 and is introduced into a separator 7. At the same time, appropriate amount of the above substances from the bottom of the tower is routed the separator 7 so as to facilitate heavy gas oil with boiling point higher than 470° C. to be absorbed and separated from the thermal reaction products, and recycled back to solvent deasphalting process 4 to be mixed with feed and continue to be extracted. The gas, solvent and thermal cracking oil with the boiling point lower than 470° C. are obtained after the remaining thermal reaction products being distilled and separated. The gas, which is purified by removing $H_2S$, is recovered. The solvent is recycled back to the deasphalting process 4 and continues to be used as solvent. The upgraded oil is obtained through mixing the thermal cracking oil, vacuum gas oil distillate and the de-asphalted oil. Through tests, the upgraded oil: yield: 80.83 wt % (84.94 v %); API: 16.0; carbon residue: 4.11 wt %; sulfur content: 3.23 wt %; content of Ni and V: 9.6 μg/g and 41.9 μg/g; the yields of by-products gas and coke: 4.67 wt % and 14.5 wt %.

The above upgraded oil is further subjected to fixed-bed hydrotreating process 8 and the hydrotreating upgraded oil is obtained. The hydrotreating process: temperature: 400° C.; reaction pressure: 15.0 Mpa; hydrogen-oil ratio (volume ratio): 1200:1; space velocity of reactor: 1.0 h$^{1}$. The obtained hydrotreating upgraded oil: yield: 78.20 wt % (88.31 v %); API gravity: 27.1; sulfur content: 0.19 wt %; carbon residue: 0.80 wt %; asphaltene<0.05 wt %; content of Ni and V: 0.5 μg/g and 1.0 μg/g.

Distribution and Properties of Feedstock and Products of Upgraded Oil Are as Follows:

| Feedstock wt %(v %) | API Gravity | | S wt % | Carbon Residue wt % | C7Asphaltene wt % | Ni μg/g | V μg/g |
|---|---|---|---|---|---|---|---|
| 100 | 8.7 | | 4.0 | 15.1 | 9.5 | 80 | 410 |
| | | | Products Distribution wt % | | | | |
| | C5+ Oil Yield | | Initial Boiling | | | | |
| | wt % | Vol % | Point-200° C. | 200-350° C. | 350-500° C. | 500° C.+ | |
| Upgraded Oil | 80.83 | 84.94 | 4.31 | 20.14 | 31.92 | 43.64 | |
| | API Gravity | | S wt % | Carbon Residue wt % | C7Asphaltene wt % | Ni μg/g | V μg/g |
| | 16.0 | | 3.23 | 4.11 | 0.19 | 9.6 | 41.9 |
| | | | Products Distribution wt % | | | | |
| | C5+ Oil Yield | | Initial Boiling | | | | |
| | wt % | Vol % | Point-200° C. | 200-350° C. | 350-500° C. | 500° C.+ | |
| Hydrotreating Upgraded Oil | 78.20 | 88.31 | 14.66 | 16.88 | 47.29 | 21.17 | |
| | API Gravity | | S wt % | Carbon Residue wt % | C7Asphaltene wt % | Ni μg/g | V μg/g |
| | 27.1 | | 0.19 | 0.80 | <0.05 | 0.5 | 1.0 |

EXAMPLE 6

Indonesia Buton Island oil sand bitumen: API: 7.8; sulfur content: 6.67 wt %; Conradson carbon residue (CCR): 17.5%; the content of Ni and V: 47.5 μg/g and 144 μg/g.

With atmospheric distillate and 350° C. of cut point, 6.49 wt % of 200-350° C. light gas oil distillate is obtained.

The mixed solvent of n-pentane and n-hexane (n-pentane/n-hexane=80:20) is used as extraction solvent and the substances from the bottom of the atmospheric distillation tower is subjected to deasphalting process. The specific operation is as described in Example 1. The mass ratio of total solvent to oil feedstock is 3.7:1, wherein the main solvent:auxiliary solvent:dispersing solvent=0.676:0.270:0.054; the temperature of the bottom of the extraction tower: 160° C.; the temperature of the top of the tower: 180° C.; extraction pressure: 6.0 MPa.

The solvent in the de-asphalted oil discharged from the extraction tower 4 is firstly recovered under supercritical conditions of 5.85 MPa and 260° C. (the solvent density is 0.200 g/cm$^3$ at this time). The remaining solvent is further recovered by steam stripping.

The de-oiled asphalt phase, discharged from an extraction tower 4, including the extraction solvent and mixed with dispersing solvent, is dispersed into a thermal cracking tower 6 by mist spray. After contacting with 680° C. hot coke particles, the temperature of the de-oiled asphalt reaches 500°

C., and then the thermal reaction occurs to produce reaction products. The produced solid coke is discharged from the bottom of the thermal cracking tower 6. The solvent in the asphalt phase together with the reaction products flow out of the top of the thermal cracking tower 6 and is introduced into a separator 7. At the same time, appropriate amount of the substances from the bottom of the abovementioned tower is routed the separator 7 so as to facilitate heavy gas oil with boiling point higher than 470° C. to be absorbed and separated from the thermal reaction products, and recycled back to deasphalting process 4 to be mixed with feed and continue to be extracted. The gas, solvent and thermal cracking oil with the boiling point lower than 470° C. are obtained after the remaining thermal reaction products are distilled and separated. The gas, which is purified by removing $H_2S$, is recovered. The solvent is recycled back to the deasphalting process and continues to be used as solvent. The upgraded oil is obtained through mixing the thermal cracking oil, light gas oil distillate and the de-asphalted oil. Through tests, the upgraded oil: yield: 79.30 wt % (83.04 v %); API: 15.2; carbon residue: 5.05 wt %; sulfur content: 6.55 wt %; content of Ni and V: 8.14 μg and 23.65 μg/g; the yields of by-products gas and coke: 4.77 wt % and 15.93 wt %.

The above upgraded oil is further subjected to fixed-bed hydrotreating process 8 and hydrotreating upgraded oil can be obtained, wherein the hydrotreating process is conducted under the conditions: temperature: 400° C.; reaction pressure: 15 MPa; hydrogen-oil ratio (volume ratio): 1000:1; the space velocity of reactor: 0.8 $h^{-1}$. The obtained hydrotreating upgraded oil: yield: 75.60 wt % (85.26 v %); API gravity: 26.5; sulfur content: 0.31 wt %; carbon residue: 1.85 wt %; asphaltene: 0.07 wt %; content of Ni and V: 0.7 μg/g and 1.2 μg/g.

Distribution and Properties of Raw Material and Products of Upgraded Oil Are as Follows:

| Feedstock wt %(v %) | API Gravity | | S wt % | Carbon Residue wt % | C7Asphaltene wt % | Ni μg/g | V μg/g |
|---|---|---|---|---|---|---|---|
| 100 | 7.8 | | 6.67 | 17.5 | 12.9 | 47.5 | 144 |
| | | | Products Distribution wt % | | | | |
| | C5+ Oil Yield | | Initial Boiling | | | | |
| | wt % | vol % | Point-200° C. | 200-350° C. | 350-500° C. | 500° C.+ | |
| Upgraded Oil | 79.30 | 83.04 | 4.24 | 14.58 | 41.90 | 39.28 | |
| | API Gravity | | S wt % | Carbon Residue wt % | C7Asphaltene wt % | Ni μg/g | V μg/g |
| | 15.2 | | 6.55 | 5.05 | 0.23 | 8.14 | 23.65 |
| | | | Products Distribution wt % | | | | |
| | C5+ Oil Yield | | Initial Boiling | | | | |
| | wt % | vol % | Point-200° C. | 200-350° C. | 350-500° C. | 500° C.+ | |
| Hydrotreating Upgraded Oil | 75.60 | 85.26 | 10.77 | 16.28 | 53.62 | 19.34 | |
| | API Gravity | | S wt % | Carbon Residue wt % | C7Asphaltene wt % | Ni μg/g | V μg/g |
| | 26.50 | | 0.31 | 1.85 | 0.07 | 0.7 | 1.2 |

The light gas oil distillates and upgraded oil, obtained through the above integrated process, also can be stored respectively and used as oil feedstock in the subsequent process.

EXAMPLE 7

China Inner Mongolia oil sand bitumen: API: 7.8; sulfur content: 1.0 wt %; Conradson carbon residue (CCR): 17.4%; C7 asphaltene content: 27.2 wt %; the content of Ni: 16 μg/g.

As the oil sand bitumen does not include distillate with the temperature less than 350° C., the mixed solvent of n-pentane and n-hexane (n-pentane/n-hexane=90:10) is directly used as extraction solvent and the oil sand bitumen is subjected to deasphalting process. The specific operation is as described in Example 1. The mass ratio of total solvent to oil feedstock is 4.3:1, wherein the main solvent: auxiliary solvent:dispersing solvent=0.733:0.222:0.044; the temperature of the bottom of the extraction tower: 160° C.; the temperature of the top of the tower: 170° C.; extraction pressure: 5.8 MPa.

The solvent in the de-asphalted oil discharged from the extraction tower 4 is firstly recycled under supercritical conditions of 5.7 MPa and 240° C. (the solvent density is 0.234 g/$cm^3$ at this time). The remaining solvent is further recycled by steam stripping.

The de-oiled asphalt phase, discharged from an extraction tower 4, including the extraction solvent and mixed with dispersing solvent, is dispersed into a thermal cracking tower 6 by mist spray. After contacting with 680° C. hot coke particles, the temperature of the de-oiled asphalt reaches 500° C., and then thermal reaction occurs to produce reaction products. The produced solid coke is discharged from the bottom of the thermal cracking tower 6. The solvent in the asphalt phase together with the reaction products flow out of the top of the thermal cracking tower 6 and is introduced into a separator 7. At the same time, appropriate amount of oil feedstock is routed the separator 7 so as to facilitate heavy gas oil with boiling point higher than 450° C. to be absorbed and separated from the thermal reaction products, and recycled back to deasphalting process 4 to be mixed with oil feedstock and continue to be extracted. The gas, solvent and thermal cracking oil with the boiling point lower than 450° C. are obtained after the remaining thermal reaction products are distilled and separated. The gas, which is purified by removing $H_2S$, is recovered. The solvent is recycled back to the deasphalting process and continues to be used as solvent. The upgraded oil is obtained through mixing the obtained thermal cracking oil and the de-asphalted oil. The upgraded oil: yield: 72.65 wt % (76.52 v %); API: 16.1; carbon residue: 5.51 wt %; sulfur content: 0.74 wt %; the content of Ni: 3.0 μg, the yields of by-products gas and coke: 7.9 wt % and 19.45 wt %.

Distribution and Properties of Feedstock and Products of Upgraded Oil Are as Follows:

| Feedstock wt %(v %) | API Gravity | S wt % | Carbon Residue wt % | C7Asphaltene wt % | Ni μg/g |
|---|---|---|---|---|---|
| 100 | 7.8 | 1.0 | 17.4 | 27.2 | 16 |

| | C5+ Oil Yield | | Products Distribution wt % | | | |
|---|---|---|---|---|---|---|
| | wt % | Vol % | Initial Boiling Point-200° C. | 200-350° C. | 350-500° C. | 500° C.+ |
| Upgraded Oil | 72.65 | 76.52 | 9.88 | 16.19 | 25.10 | 48.83 |

| API Gravity | S wt % | Carbon Residue wt % | C7Asphaltene wt % | Ni μg/g |
|---|---|---|---|---|
| 16.1 | 0.74 | 5.51 | 0.94 | 3.0 |

What is claimed is:

1. A integrated process for processing heavy oil, comprising at least the following processes, wherein:

a heavy oil feedstock, which substantially does not comprise <350° C. atmospheric distillates, is used as feed and subjected to solvent deasphalting process in an extraction tower with an extraction solvent, a de-asphalted oil and a de-oiled asphalt phase including the extraction solvent are collected;

the de-oiled asphalt phase including the extraction solvent is mixed with a dispersing solvent and then enters into a thermal cracking reactor to be subjected to a thermal cracking process, so as to obtain thermal cracking reaction product and coke, the thermal cracking reaction product is led out, gas, solvent, thermal cracking oil and 450° C.+ heavy gas oil are separated therefrom;

the solvent separated from the thermal cracking product is recycled back to the solvent deasphalting process to be recycled, the 450° C.+ heavy gas oil is recycled back to the solvent deasphalting process to be used as mixed feed;

upgraded oil is obtained through mixing the de-asphalted oil and the thermal cracking oil separated from the thermal cracking reaction product.

2. The integrated process for processing the heavy oil according to claim 1, further including:

pre-fractionating a heavy oil feedstock including <350° C. atmospheric distillates; collecting distilled oil; products from the bottom of a distillation tower being taken as the feed for the solvent deasphalting process; wherein the cut point temperature of the prefractionation is 350-565° C., and the distilled oil is taken as light oil to be processed, or mixed with the de-asphalted oil and the thermal cracking oil to form upgraded oil.

3. The integrated process for processing the heavy oil according to claim 2, wherein during the solvent deasphalting process, a first extraction solvent is mixed with the feed and entered into the extraction tower; separating the de-asphalted oil and the asphalt phase; a second extraction solvent is added to the bottom of the extraction tower to further extract the asphalt phase, so as to separate the de-asphalted oil; the de-asphalted oil is discharged from the top of the extraction tower; obtained de-oiled asphalt phase including the extraction solvent is discharged from the bottom of the extraction tower and subjected to thermal cracking process after being mixed with the dispersing solvent; the first extraction solvent, the second extraction solvent and the dispersing solvent are selected from C3-C6 alkane or mixed fractions thereof; total mass flow ratio of the three solvents to the feed of the extraction tower is 3-8:1, wherein solvent distribution proportion is: the first extraction solvent: the second extraction solvent: the dispersing solvent is (0.75-0.93) : (0-0.15) : (0.02-0.10) .

4. The integrated process for processing the heavy oil according to claim 3, wherein the temperature of the extraction tower is 80-250° C. and the pressure is 3.5-10 MPa.

5. The integrated process for processing the heavy oil according to claim 2, wherein the thermal cracking reaction product is firstly absorbed by the substances from the bottom of the tower after prefractionation and cut-fraction; the 450° C.+ heavy gas oil is separated, and the gas, the solvent and the thermal cracking oil are further distilled and separated from the remaining thermal cracking reaction product.

6. The integrated process for processing the heavy oil according to claim 1, further including:

subjecting the upgraded oil to fixed-bed hydrotreating process to obtain a hydrotreating upgraded oil.

7. The integrated process for processing the heavy oil according to claim 6, wherein during the process that the upgraded oil becomes hydrotreating upgraded oil after undergoing fixed bed hydrotreating, in the hydrotreating process, the temperature is 360-450° C., the pressure is 6-20 MPa, the hydrogen-oil volume ratio is 200-1200:1, and space velocity of the reactor is 0.3-3.0 $h^{-1}$.

8. The integrated process for processing the heavy oil according to claim 1, wherein during the solvent deasphalting process, a first extraction solvent is mixed with the feed and entered into the extraction tower; separating the de-asphalted oil and the asphalt phase; a second extraction solvent is added from the bottom of the extraction tower to further extract the asphalt phase, so as to separate the de-asphalted oil; the de-asphalted oil is discharged from the top of the extraction tower; obtained de-oiled asphalt phase including the extraction solvent is discharged from the bottom of the extraction tower and subjected to thermal cracking process after being mixed with the dispersing solvent; the first extraction solvent, the second extraction solvent and the dispersing solvent are selected from C3-C6 alkane or mixtures thereof; total mass flow ratio of the three solvents to the feed of the extraction tower is 3-8:1, wherein solvent distribution proportion is: the first extraction solvent: the second extraction solvent: the dispersing solvent is (0.75-0.93) : (0-0.15) : (0.02-0.10) .

9. The integrated process for processing the heavy oil according to claim 8, wherein the temperature of the extraction tower is 80-250° C. and the pressure is 3.5-10 MPa.

10. The integrated process for processing the heavy oil according to claim 8, wherein the distribution proportion of the three solvents is: the first extraction solvent : the second extraction solvent : the dispersing solvent=(0.75-0.93) : (0.05-0.15) : (0.02-0.10) .

11. The integrated process for processing the heavy oil according to claim 10, wherein the temperature of the high-temperature hydrocarbon vapor and the high-temperature steam is 500-600° C., the high-temperature coke particles which are partially burned, or inorganic particles loaded with burned coke is coke discharged from the thermal cracking reaction, coke attached to the inorganic particles or heat providing media which are recycled back to the thermal cracking reactor after being partially burned at a temperature up to 600-750° C.

12. The integrated process for processing the heavy oil according to claim 11, wherein the average temperature of the thermal cracking reaction is 450-550° C.

13. The integrated process for processing the heavy oil according to claim 1, wherein the de-asphalted oil separated from the solvent deasphalting process undergoes supercritical separation and / or steam stripping to recover the extraction solvent in the de-asphalted oil, in the supercritical separation, solvent density is controlled in the rage of 0.15-0.20 g/cm$^3$.

14. The integrated process for processing the heavy oil according to claim 1, wherein the de-oiled asphalt including the extraction solvent is dispersed into the thermal cracking reactor by injection and contact with high-temperature heat providing media to undergo thermal reactions and obtain thermal cracking reaction products, the high-temperature heat providing media include high-temperature oil gas, high-temperature steam, high-temperature coke particles which are partially burned, or inorganic particles loaded with burned coke.

15. The integrated process for processing the heavy oil according to claim 14, wherein the average temperature of the thermal cracking reaction is 450-550° C.

16. The integrated process for processing the heavy oil according to claim 15, wherein the average temperature of the thermal cracking reaction is 470-530° C.

17. The integrated process for processing the heavy oil according to claim 14, wherein the thermal cracking reaction product is firstly absorbed by the heavy oil feed; the 450° C.+ heavy was oil gas oil is separated, and the gas, the solvent and the thermal cracking oil are further distilled and separated from the remaining thermal cracking reaction product.

18. The integrated process for processing the heavy oil according to claim 14, wherein the thermal cracking reaction product is firstly absorbed by the substances from the bottom of the tower after prefractionation and cut-fraction; the 450° C.+ heavy gas oil is separated, and the gas, the solvent and the thermal cracking oil are further distilled and separated.

19. The integrated process for processing the heavy oil according to claim 1, wherein the thermal cracking reaction product is firstly absorbed by the heavy oil feed; the 450° C.+ heavy was oil gas oil is separated, and the gas, the solvent and the thermal cracking oil are further distilled and separated from the remaining thermal cracking reaction product.

20. The integrated process for processing the heavy oil according to claim 1, wherein the heavy oil comprises heavy crude oil or oil sand bitumen.

* * * * *